US007288034B2

(12) United States Patent
Woodard et al.

(10) Patent No.: US 7,288,034 B2
(45) Date of Patent: Oct. 30, 2007

(54) ADJUSTABLE HEIGHT, SELF-PROPELLED BASKETBALL GOAL SUPPORT

(76) Inventors: Danny Woodard, 4102 Mowery, Houston, TX (US) 77047; D. Eugene Manning, 604 Lewis, Fruitland Park, FL (US) 34731

( * ) Notice: Subject to any disclaimer, the term of this patent is extended or adjusted under 35 U.S.C. 154(b) by 257 days.

(21) Appl. No.: 11/090,313

(22) Filed: Mar. 26, 2005

(65) Prior Publication Data

US 2005/0215358 A1 Sep. 29, 2005

Related U.S. Application Data

(60) Provisional application No. 60/557,328, filed on Mar. 29, 2004.

(51) Int. Cl.
*A63B 63/08* (2006.01)

(52) U.S. Cl. ..... 473/479; 473/481

(58) Field of Classification Search ..... 473/479–484; 318/581; 180/19.1, 342, 167
See application file for complete search history.

(56) References Cited

U.S. PATENT DOCUMENTS 1,598,124 A * 8/1926 Evans ..... 180/342
2,986,395 A * 5/1961 Sheftel ..... 473/483
3,391,936 A * 7/1968 Grimes ..... 473/439
4,621,984 A * 11/1986 Fussell ..... 417/234
5,102,128 A * 4/1992 Geise ..... 473/483
5,601,284 A * 2/1997 Blackwell et al. ..... 473/483
5,879,247 A 3/1999 Winter et al.
5,919,102 A 7/1999 Smith et al.
6,155,938 A 12/2000 Mower
6,276,471 B1 * 8/2001 Kratzenberg et al. ..... 180/19.3
6,302,811 B1 * 10/2001 Topham ..... 473/484
6,432,003 B1 8/2002 van Nimwegen
6,488,599 B2 12/2002 Nye
6,554,243 B2 4/2003 Davis et al.

* cited by examiner

*Primary Examiner*—Eugene Kim
*Assistant Examiner*—M. Chambers
(74) *Attorney, Agent, or Firm*—Richard A. Fagin

(57) ABSTRACT

A basketball goal support structure includes a support base and a pneumatic cylinder coupled to the support base. A pneumatically operated rod is extendably disposed insure the pneumatic cylinder. The rod is adapted to couple a basketball goal assembly to the end of the rod. The structure includes means for controllably applying pneumatic pressure to the interior of the cylinder to lift the rod out the cylinder, and means for self-propelling the base to a selected location.

19 Claims, 4 Drawing Sheets

ADJUSTABLE HEIGHT, SELF-PROPELLED BASKETBALL GOAL SUPPORT

CROSS-REFERENCE TO RELATED APPLICATIONS

Priority is claimed from U.S. Provisional Application No. 60/557,328 filed on Mar. 29, 2004.

STATEMENT REGARDING FEDERALLY SPONSORED RESEARCH OR DEVELOPMENT

Not applicable.

BACKGROUND OF THE INVENTION

1. Field of the Invention

The invention relates generally to the field of sporting equipment. More specifically, the invention relates to portable support structures for basketball goals which have adjustable goal backing height.

2. Background Art

Basketball goal structures known in the art include various height adjusting mechanisms, and various devices to make the basketball goal portable. Representative prior art basketball goals are described below.

U.S. Pat. No. 6,554,243 issued to Davis et al. Discloses a rollable sports ballast base for supporting a sports apparatus support member. The ballast base includes a base member having a top and bottom surface. The bottom surface contacts a ground support surface such as a driveway or other playing surface. There is at least one wheel assembly, retractable from a lowered position to a raised position. The wheel assembly includes a pivoting connector coupled to the base member and a wheel bracket coupled to the pivoting connector. The wheel bracket includes an axle, at least one wheel, and a handle extending outwardly from the wheel bracket. The handle is used to pivotally rotate the wheel assembly about a transverse axis. When the handle is rotated away from the base member, the wheel assembly is placed in a lowered position whereby the wheel contacts the support surface, thus separating the bottom surface of the base member from the support surface.

U.S. Pat. No. 6,488,599 issued to Nye relates to quick-release locking mechanisms for adjustable basketball goal systems, and methods for using the same to adjust the height of a basketball goal above a playing surface. An adjustable basketball goal system may include basketball goal connected to a rigid support via a deformable goal support structure. A second arm may be coupled to the rigid support. A first arm may be coupled to the deformable goal support structure and may slidably engage the second arm. Locking plates may selectively bind the second arm with respect to the first arm to selectively lock relative motion of the arms. Locking relative motion is performed to maintain the basketball goal at a desired height. In an alternative embodiment, an engagement grip maybe attached to the first arm, and may contain multiple locking members configured to pivot to simultaneously engage openings formed in the second arm to prevent movement of a first arm relative to the second arm. In another alternative embodiment, an engagement grip may have only a single locking member configured to slide into one of a plurality of openings disposed along the length of the second arm.

U.S. Pat. No. 6,432,003 issued to van Nimwegen discloses a portable basketball goal system having an adjustable wheel assembly. The portable basketball goal system may comprise a rigid pole, a support base, an adjustable wheel assembly, and an engaging member. The support base is configured to maintain the rigid pole in a generally elevated position. The adjustable wheel assembly is connected to the support base and has an engaged and disengaged position. In the engaged position, the wheel assembly supportably engages a playing surface. In the disengaged position the wheel assembly does not supportably engage the playing surface. The adjustable wheel assembly may be slidably coupled to the support base. The adjustable wheel assembly may be operated by an engaging member coupled to a cam surface. The cam surface may interact with a follower to move the adjustable wheel assembly between the engages and disengaged positions.

U.S. Pat. No. 6,155,938 issued to Mower relates to a push button height adjustment mechanism for a basketball goal assembly. The mechanism is for adjusting the height of a basketball goal above a playing surface. The basketball goal assembly includes a deformable goal support structure interposed between a rigid support member and a basketball goal. A first end of an extension arm pivotally connects to an extension that protrudes from the back side of the goal support structure. A second end of the extension arm is pivotally connected to the support member. An adjustment mechanism disposed in relation to the extension arm allows the length of the extension arm to be adjusted. The adjustment of the length of the extension arm selectively deforms the goal support structure, thereby adjusting the height of the basketball goal in relation to the playing surface. A counterbalance member is operably disposed in relation to the goal support structure to facilitate counterbalancing between the weight of the basketball goal and a tensile force applied to the extension arm. The adjustment mechanism may comprise a spring-biased push button mechanism. With the use of the spring-biased push button mechanism, a user is capable of adjusting the height of the basketball goal in relation to the playing surface using only a single hand.

U.S. Pat. No. 5,879,247 issued to Winter et al. discloses an adjustable basketball goal system for adjusting the height of a basketball goal above a playing surface. The basketball goal includes a deformable parallelogram structure attached at one end to a rigid support. A basketball goal is attached to the other end of the parallelogram structure. An adjustment lever is pivotally mounted to the rigid support below the parallelogram structure. An extension arm is positioned between the parallelogram structure and the adjustment lever such that movement of the adjustment lever deforms the parallelogram structure which repositions the basketball goal to a different height above the playing surface. A lockable piston assembly is attached to the rigid support and to the adjustment lever. The piston assembly includes a switch which locks the piston assembly preventing the parallelogram structure from deforming. An actuation trigger pivotally connected to the adjustment lever can be engaged to move the switch to an unlocked position thereby allowing the height of the basketball goal to be adjusted. The piston assembly also serves to counterbalance the weight of the basketball goal such that the height of the basketball goal can be adjusted with minimal force.

U.S. Pat. No. 5,919,102 issued to Smith et al. discloses a mobile or permanently fixed basketball goal system. In the system disclosed in the Smith et al. '102 patent, the backboard and hoop can be adjusted to a desired height by a user. The goal system has a vertical support member having a base end, a backboard end and an intermediate portion, and a backboard including a hoop. Crossmembers pivotally connect the backboard to the vertical support member on one side of the backboard end, to form an adjustable parallelogram. At least one of the crossmembers extends beyond the vertical support member to an extension end. A clamp is mounted on a brace for the vertical support member or directly on the vertical support member. The clamp is fixedly adjustable within a continuous range and connects with the counterbalanced extension end via an extension member. When the clamp is moved, it acts to rotate the extending crossmember to raise or lower the backboard and hoop.

SUMMARY OF THE INVENTION

One aspect of the invention is a basketball goal support structure. A support structure according to this aspect of the invention includes a support base and a pneumatic cylinder coupled to the support base. A pneumatically operated rod is extendably disposed insure the pneumatic cylinder. The rod is adapted to couple a basketball goal assembly to the end of the rod. The structure includes means for controllably applying pneumatic pressure to the interior of the cylinder to lift the rod out the cylinder, and means for self-propelling the base to a selected location.

Other aspects and advantages of the invention will be apparent from the following description and the appended claims.

DETAILED DESCRIPTION

Figure 1:
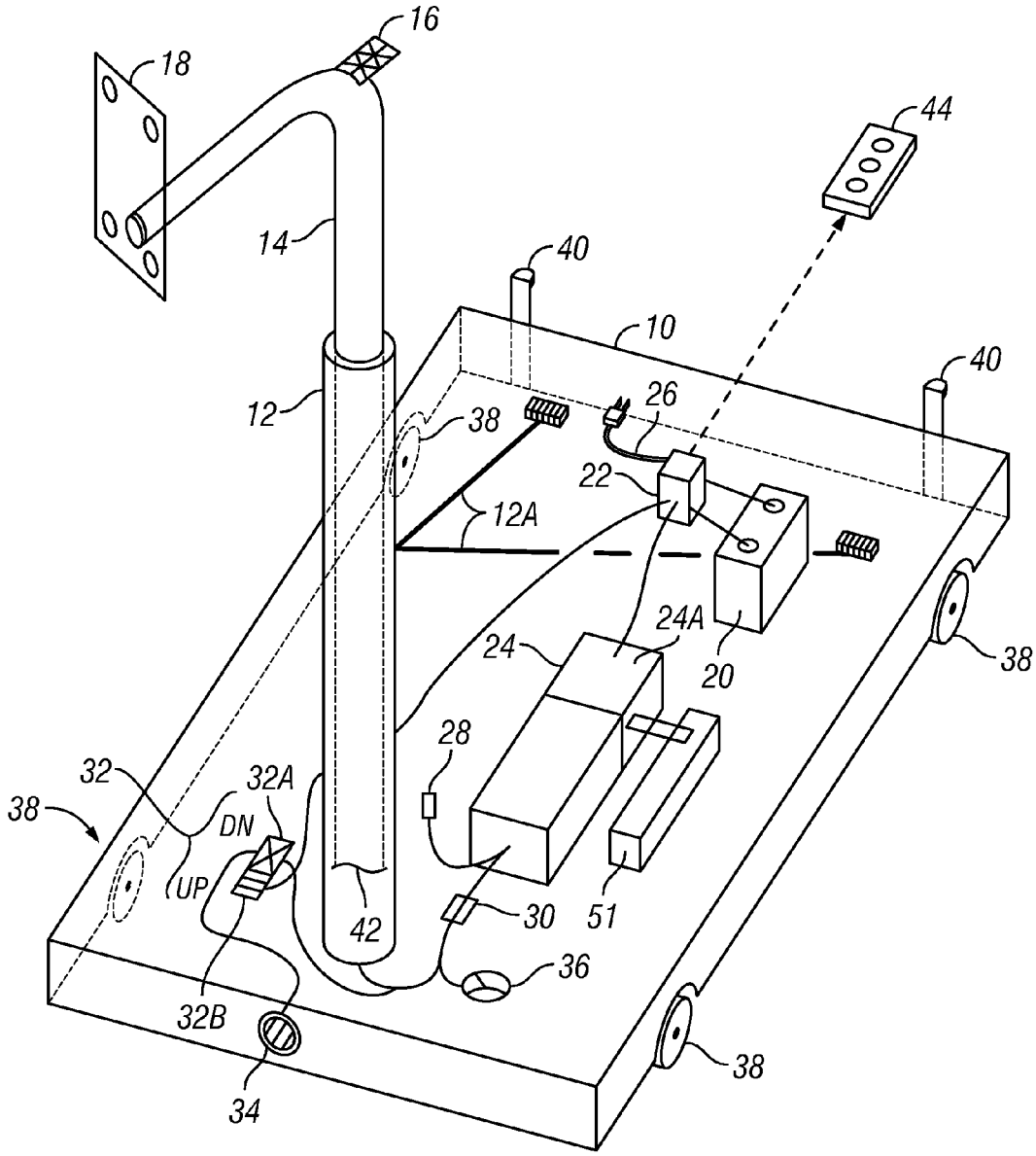
FIG. 1 shows one embodiment of a basketball goal structure according to the invention.

An embodiment of a pneumatically height-adjustable, self propelled basketball goal support structure is shown in cutaway view in FIG. 1. A goal support base 10 may be made from heavy-gauge sheet metal, such as from carbon steel or stainless steel. Heavy gauge sheet metal is preferred to provide suitable weight, so as to reduce the possibility of tipping the goal support structure during use. Preferred dimensions for the base are about 4 feet in length, about 3½ feet in width and about 1 foot height. A pneumatic cylinder 12 is affixed to the base 10. The pneumatic cylinder 12 may be supported laterally by braces 12A, which may be welded or otherwise affixed to the base 10. Materials from which the base 10, cylinder 12 and braces 12A are made is a matter of discretion, however considerations of strength, resistance to corrosion, ability to withstand internal pressures inside the cylinder 12, and mass are desirable when selecting such materials. As will be readily appreciated, using dense, high strength materials such as steel will provide the goal support structure with suitable mass to prevent undue movement during play.

A pneumatic piston 42 and rod assembly 14 are disposed inside the pneumatic cylinder 12. As will be further explained with reference to FIG. 2, the rod 14 and piston are suitably sealed with respect to the interior of the cylinder 12 such that application of pneumatic pressure to the lower portion of the cylinder 12 will cause the piston 42 and the rod 14 to move upwardly, out of the cylinder 12. In FIG. 1, the rod 14 is shown as being made from a single tubular element and having essentially a right-angle bend in its upper portion, such that a goal support plate 18 may be affixed at an end of the rod 14. However other suitable structures for forming the rod 14 to as to both lift vertically out of the cylinder 12 and include provision for affixing the support plate 18 will occur to those of ordinary skill in the art. The configuration shown in FIG. 1 is intended to place the goal support plate 18 in a position extended outwardly from the base 10 to avoid interference during play.

The support plate 18 may be suitably configured to affix thereto a conventional basketball goal backboard, hoop and net assembly (not shown). The rod 14, as shown in FIG. 1, or alternatively the cylinder 12 itself, may include a pressure relief valve 16 set at a suitable safe pressure such that seal bursting is avoided and that excessive lifting pressure is not applied to the piston 42 and rod 14. The relief pressure which actuates the relief valve 16 can also be selected to lower any person(s) hanging on the rim of the goal for an extended period.

Propulsion of the base 10 from one location to another may be performed by a self propulsion system 51 having retractable wheels 38. The self propulsion system 51 will be explained with reference to FIG. 4. The purpose of including retractable wheels is to provide the base 10 with additional stability against tipping when the goal support is in use.

The goal support structure may include a manual or foot-operated air pump (not shown). The present embodiment includes a battery 20 or similar electric power storage for remotely operating an air compressor 24. The compressor 24 may be a conventional rotary, positive displacement pump driven by an electric motor 24A, or may be a foot or hand operated pump as previously explained. The compressor 24 provides pneumatic pressure to raise the rod 14 as needed, and may also be used to provide air pressure such as for inflating basketballs or inflatable toys. The motor 24A may be controlled by a controller 22. The controller 22 may include a microprocessor, and typically includes any well known type of motor control to operate the motor 24A as needed. The controller 22 may be operated by a foot switch 32 disposed on the base 10, thereby operating the compressor 24 to raise the rod 14, or the controller 22 may in addition, be operated by a remote control 44. The remote control 44 may be hard-wired to the controller or may use any well known control link such as infrared or radio telemetry. The controller 22 may also be configured to operate the self propulsion system 51 (see FIG. 4). The motor 24A may in some embodiments drive the self-propulsion system 51 under control of the controller 22. In other embodiments, the self propulsion system 51 may include a separate motor. In some embodiments, the controller 22 may include suitable circuits (not shown separately) for conditioning ordinary house current to charge the battery 20 and/or to operate the motor 24A. House current may be supplied through a suitable cord and plug assembly 26.

When actuated, the compressor 24 pumps air into the lower end of the cylinder 12. A check valve 30 may be included in the pneumatic connection between the compressor 24 output and the lower part of the cylinder 12 such that air pressure is maintained therein after the compressor 24 is stopped. The compressor 24 output may also be coupled to a utility port 28. The utility port 28 may be used for general compressed air purposes, as explained above, including ball and toy inflation. Pressure within the cylinder 12 may be monitored by a pressure gauge 36. If, during use the pneumatic pressure drops such that the rod 14 may drop into the cylinder 12, the compressor 24 may be actuated so as to restore the pressure to a suitable level. If the pressure drop has occurred because a person was hanging on the goal, actuating the compressor should only be performed when the person stops hanging on the goal and the relief valve has stopped discharging.

The present embodiment of the base 10 includes provision for retaining balancing stakes 40 at the end of the base 10 opposite to the location of the cylinder 12 and rod 14. The stakes 40 which may be hammered into suitable ground surface, for maintaining balance and stability of the goal support structure during play.

In use, the goal support structure may be moved to a selected location for play by actuating the self propulsion unit 51 (see FIG. 4), which includes lowering the wheels 38 to their movement position and driving the goal support structure to the selected location. At the selected location, the wheels 38 may be retracted, such that the base 10 rests entirely on the ground surface. In suitable ground surface conditions, the balancing stakes 40 may be hammered into the ground to further support the goal support structure. The compressor 24 may then be actuated by operating the foot switch 32 to the "up" position, which closes an electrical switch 32B such that the compressor 24 is actuated. Operating the compressor 24 continues until the rod 14 is raised such that the goal support 18 is moved to a desired height. Measurements of selected heights, such as 4, 6, 8, 10 and 12 feet should be clearly scribed on the rod 14 to enable the user to set the goal at a known, selected height. If too much height is attained, or at the time the goal is desired to be lowered, the foot switch 32 may be operated in the "down" position, so as to operate a valve 32A to release pressure from inside the cylinder 12. Alternatively, the compressor 24 may be operated by the remote control 44. Similarly, the valve 32A may include a suitable electrical actuation device (not shown) such that the remote control 44 may be used to raise and lower the rod 14. The arrangement of pneumatic and electrical connections in FIG. 1 is provided to illustrate the principle by which the goal support structure of the invention operates, and is not strictly intended to limit the scope of the invention.

Figure 2:
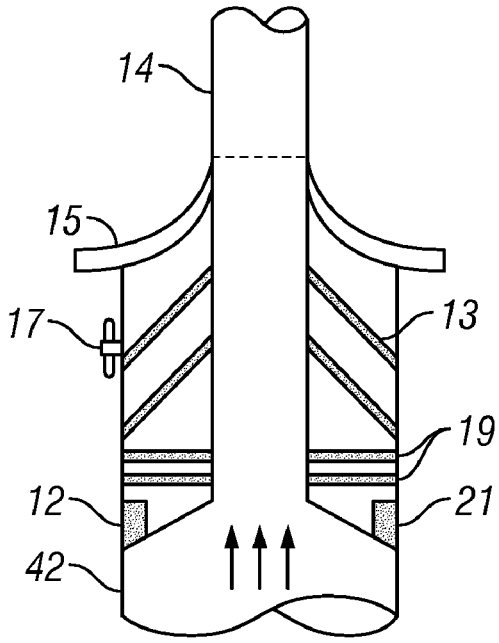
FIG. 2 shows a cross section of an upper portion of a pneumatic cylinder used to adjust the goal height.

The upper portion of the cylinder 12, including detail of the piston 42 and rod 14 are shown in FIG. 2. The cylinder 12 includes on its interior wall, at a suitable position near the longitudinal end, a stop or limit 21, which prevents the piston 42 from moving beyond a selected position. The rod 14 may be sealed to the inner surface of the cylinder 12 by o-rings 19 or the like. Similar sealing may be included on the exterior surface of the piston 42. A generally conically shaped weather seal 15 may be included on the top of the cylinder 12 and seal against the outside of the rod 14, to deflect rain and water from entering the interior of the cylinder 12. A secondary weather seal 13 may be included below the weather seal 15 and above the limit 21. A spill port 17 may be located above the secondary seal 13 to enable and moisture that does bypass the weather seal 15 to exit the cylinder 12 and thus reduce the chance of harming the components inside the cylinder.

Figure 3:
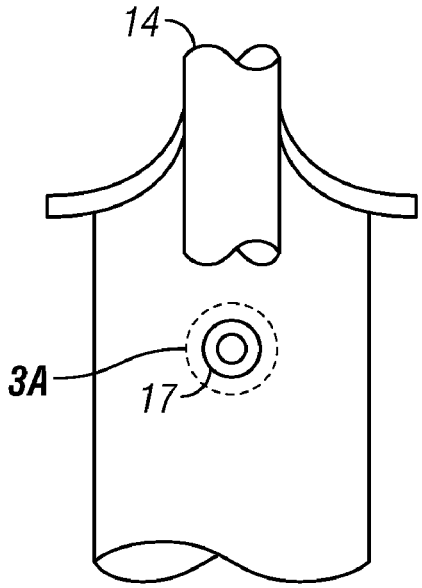
FIG. 3 shows an external drip port for the upper cylinder section of FIG. 2.
Figure 3A:
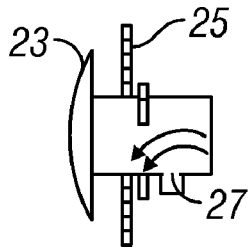
FIG. 3A shows a spill port cover in greater detail.

FIG. 3 shows a preferred position of the spill port 17. FIG. 3A shows one embodiment of the spill port 17 as including a rounded-head cap 23, a weather seal 25, and a drip hole 27. The embodiment of FIG. 3A is designed to avoid creating a safety hazard where at the spill port 17, to generally exclude rain water from entering the spill port 17, and enabling relatively free discharge of water from the spill port 17.

Figure 4:
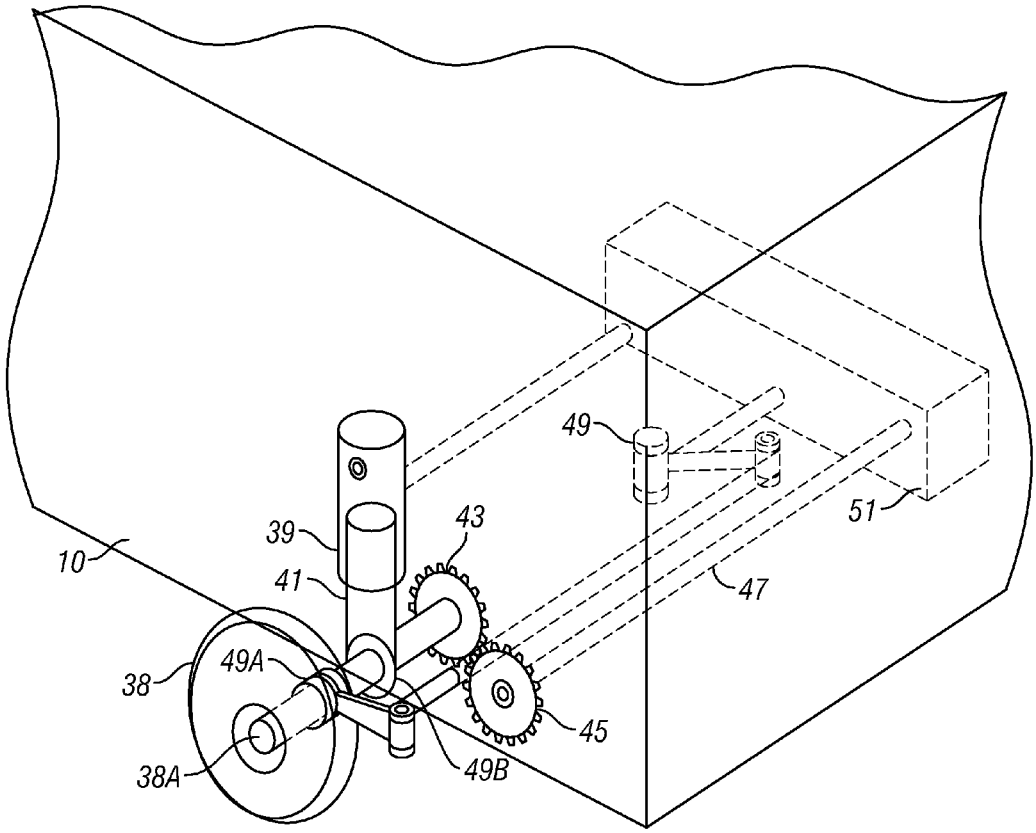
FIG. 4 shows one example of a self-propulsion device with retractable wheels.

FIG. 4 shows an embodiment of self-propulsion system and retraction system for one of the wheels 38. The wheel 38 is fixedly supported on a drive shaft 38A. The drive shaft 38A is rotatably supported by a bearing 49B disposed in the end a pneumatic lift rod 41, and by another bearing 49A disposed in a lateral actuation linkage 49.

The pneumatic lift rod 41 is disposed in a lift cylinder 39. The lift cylinder 39 may be pneumatically coupled (with suitable controlled valves) to the compressor (24 in FIG. 1) such that actuation of the compressor pressurizes the upper part of the lift cylinder 39, thus extending the lift rod 41 from the cylinder 39. This has the effect of lowering the wheel 38 to the ground. After the wheel 38 reaches the ground, continuing to extend the lift rod 41 has the effect of raising the base 10 from the ground to enable free movement. The lift system can also aid in the removal of the balancing stakes 40 from their anchored position, by lifting the base 10 from the ground. Lifting the base 10 from the ground will pull the balancing stakes 40 at least partially out of the ground.

The lateral actuation linkage 49 may be used to laterally extend and retract the drive shaft 38A and the wheel 38 from the base 10. In the retracted position, the drive shaft 38A is free to rotate, and thus the wheel 38 may freely rotate as well. In such position, the base 10 may be moved manually, if desired. If the linkage 49 is operated to extend the wheel 38 laterally outward from the base 10, a driven gear 43 on the end of the drive shaft 38A engages with a drive gear 45 disposed on the end of a motor drive shaft 47. A drive unit 51 may include a motor (not shown separately) for rotating the motor drive shaft 47, typically when so operated by the controller (22 in FIG. 1), and for operating the lateral linkage 49, such as by a worm and sector assembly (not shown separately) coupled to a suitable motor (not shown separately). In some embodiments, the lateral linkage 49 may be omitted entirely. In some embodiments, the lift cylinder 39 and lift rod 41 may be substituted by, for example, a worm and sector operated by a suitable motor, or by a hand crank. The foregoing examples are meant to illustrate the principle, and are not strictly intended to limit the scope of the invention. In some embodiments, only two of the four wheels 38 are coupled to the self propulsion system, and the other two wheels 38 may be 360 degree rotatable casters, such that under self propulsion, the goal support system may be easily steered by the used to the selected location. A manual version of the wheel assembly may be installed where the goal is moved by a stirring rod.

Figure 5A:
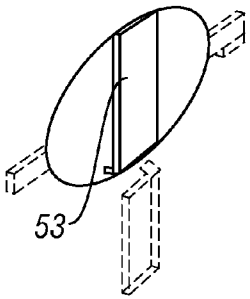
FIG. 5A shows a detail of a stake retainer.
Figure 5B:
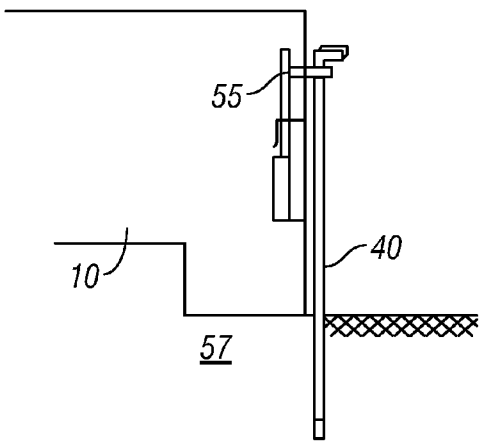
FIG. 5B shows another detail of a stake retainer.
Figure 5:
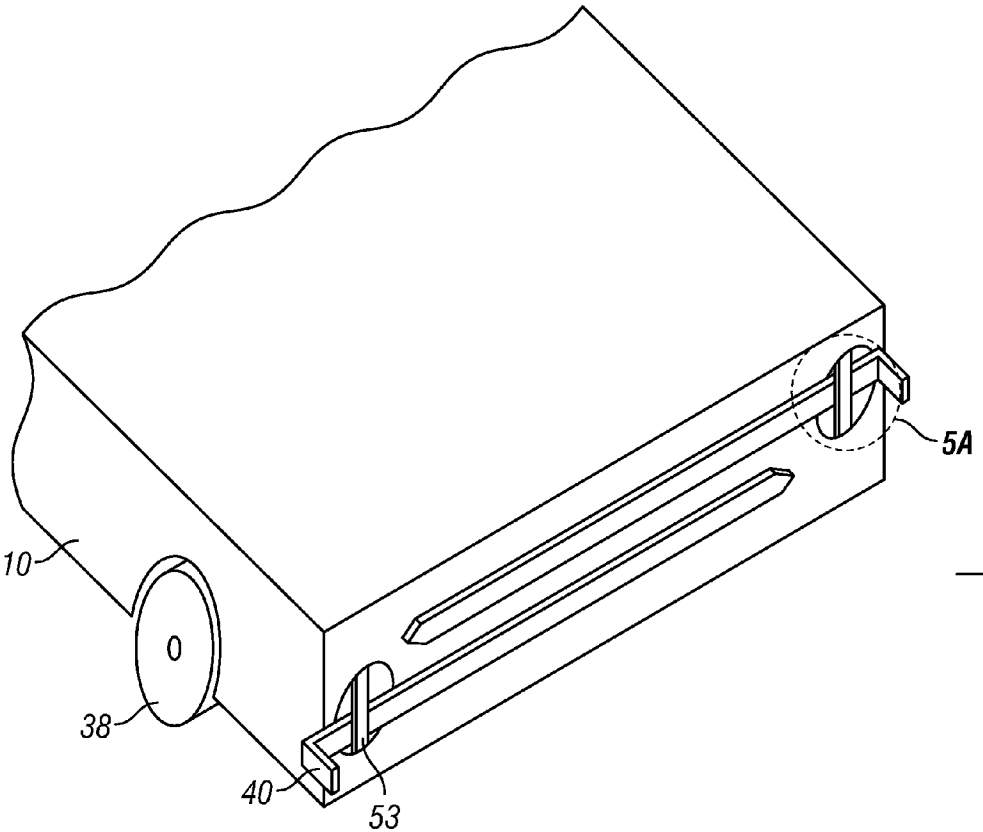
FIG. 5 shows a stake retainer used to hold balance stakes to retain the goal base.

FIG. 5 shows the back end of the base 10 in detail to illustrate a convenient means for storing the balancing stakes 40 on the back of the base 10. The stakes 40 may be held in place by storage retaining clips 51 formed into or otherwise affixed to the back of the base. FIG. 5A shows one of the storage clips 51 in detail. FIG. 5B shows a balance retaining clip 55 affixed to the back of the base 10. The stake 40 is inserted through the balancing clip 55 and is driven into the ground 57 to provide balancing support for the base 10 when the goal assembly (not shown) is affixed to the goal support (18 in FIG. 1).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A basketball goal support structure, comprising:

a support base;

a pneumatic cylinder coupled to the support base;

a pneumatically operated rod extendably disposed inside the pneumatic cylinder, the rod adapted to coupled a basketball goal assembly thereto;

means for controllably applying pneumatic pressure to the interior of the cylinder to lift the rod out the cylinder; and means for self-propelling the base to a selected location, the means for self-propelling comprising wheels retractable so as to enable the base to contact a ground surface, the wheels extendable to lift the for movement, the wheels operatively coupled to a drive motor, the wheels selectively disengageable from the drive motor to enable manual movement of the base.

2. The structure of claim 1 wherein the means for controllable applying pneumatic pressure comprises a motor driven compressor.

3. The structure of claim 2 further comprising a battery for storing electric power such that the compressor is remotely operable.

4. The structure of claim 2 further comprising a utility port coupled to an outlet of the compressor.

5. The structure of claim 2 further comprising a check valve interposed between the compressor and the cylinder such that pneumatic pressure is maintained after the compressor is stopped.

6. The structure of claim 1 further comprising means for selectively laterally extending the wheels.

7. The structure of claim 1 further comprising at least one stake retainer coupled to a side of the base opposite to a side where the cylinder is positioned.

8. The structure of claim 1 further comprising at least one balancing stake disposed in the retainer and adapted to be driven into a ground surface to support the base.

9. The structure of claim 1 further comprising a pressure relief valve operatively coupled to an interior of the pneumatic cylinder.

10. A basketball goal support structure, comprising:

a support base;

a pneumatic cylinder coupled to the support base;

a pneumatically operated rod extendably disposed inside the pneumatic cylinder, the rod adapted to coupled a basketball goal assembly thereto;

means for controllably applying pneumatic pressure to the interior of the cylinder to lift the rod out the cylinder;

means for self-propelling the base to a selected location, the means for self-propelling comprising wheels retractable so as to enable the base to contact a ground surface, the wheels extendable to lift the for movement, the wheels operatively coupled to a drive motor; and means for selectively laterally extending the wheels.

11. The structure of claim 10 wherein the means for controllable applying pneumatic pressure comprises a motor driven compressor.

12. The structure of claim 11 further comprising a battery for storing electric power such that the compressor is remotely operable.

13. The structure of claim 11 further comprising a utility port coupled to an outlet of the compressor.

14. The structure of claim 11 further comprising a check valve interposed between the compressor and the cylinder such that pneumatic pressure is maintained after the compressor is stopped.

15. The structure of claim 10 wherein the wheels selectively are disengageable from the drive motor to enable manual movement of the base.

16. The structure of claim 10 further comprising means for selectively laterally extending the wheels.

17. The structure of claim 10 further comprising at least one stake retainer coupled to a side of the base opposite to a side where the cylinder is positioned.

18. The structure of claim 10 further comprising at least one balancing stake disposed in the retainer and adapted to be driven into a ground surface to support the base.

19. The structure of claim 10 further comprising a pressure relief valve operatively coupled to an interior of the pneumatic cylinder.

* * * * *